US007422308B2

(12) United States Patent
Iwasaki

(10) Patent No.: US 7,422,308 B2
(45) Date of Patent: Sep. 9, 2008

(54) LIQUID EJECTION APPARATUS

(75) Inventor: Mitsutaka Iwasaki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 378 days.

(21) Appl. No.: 10/555,063

(22) PCT Filed: Jan. 14, 2005

(86) PCT No.: PCT/JP2005/000404

§ 371 (c)(1),
(2), (4) Date: Oct. 28, 2005

(87) PCT Pub. No.: WO2005/068204

PCT Pub. Date: Jul. 28, 2005

(65) Prior Publication Data

US 2006/0207678 A1 Sep. 21, 2006

(30) Foreign Application Priority Data

Jan. 14, 2004 (JP) ..... 2004-007370
Mar. 30, 2004 (JP) ..... 2004-100275

(51) Int. Cl.
*B41J 2/165* (2006.01)

(52) U.S. Cl. ..... 347/29; 347/30; 347/32; 347/36

(58) Field of Classification Search ..... 347/29, 347/30, 33, 32, 85, 86, 36
See application file for complete search history.

(56) References Cited

U.S. PATENT DOCUMENTS 4,558,326 A * 12/1985 Kimura et al. ..... 347/30
5,485,187 A * 1/1996 Okamura et al. ..... 347/85
7,021,750 B2 * 4/2006 Shibata et al. ..... 347/85
2005/0231563 A1 * 10/2005 Fujishiro et al.

FOREIGN PATENT DOCUMENTS

JP 06-328730 * 11/1994
JP 6-328730 A 11/1994
JP 2000-108383 A 4/2000
JP 2001-162838 A 6/2001
JP 2002-307724 A 10/2002
JP 2003-266722 A 9/2003
JP 2006212845 A * 8/2006

* cited by examiner

*Primary Examiner*—Shih-Wen Hsieh
(74) *Attorney, Agent, or Firm*—Sughrue Mion, PLLC

(57) ABSTRACT

For cleaning a recording head, a printer seals nozzles by means of a cap member and thus forms a closed circulatory system. In this state, a gear pump is activated and draws waste ink and the air from the cap member. The waste ink and the air then flow in the cap member, a check valve, a tube, the gear pump, and a different tube in this order and are introduced into a first ink cartridge. The air is introduced into a second ink cartridge through a corresponding tube as pressurized air. The check valve prevents the waste ink and the pressurized air from returning to the cap member. This suppresses backflow of the liquid and the air, and ink ejection is performed effectively.

17 Claims, 7 Drawing Sheets

LIQUID EJECTION APPARATUS

FIELD OF THE INVENTION

The present invention relates to liquid ejection apparatuses.

BACKGROUND OF THE INVENTION

Conventionally, inkjet recording apparatuses are broadly known as a type of liquid ejection apparatus. Inkjet recording apparatuses include "off-carriage" types in which an ink retainer is connected to a recording head through an ink supply tube. The ink retainer is provided in an ink cartridge as an ink container. The ink retainer is pressurized by pressurized air introduced into the ink cartridge by means of, for example, a pump. This causes the ink in the ink retainer to be sent to the recording head through the ink supply tube, so that the recording head is supplied with the ink. The ink is then ejected from the nozzles of the recording head to a recording paper as ink droplets for recording characters or images.

Typically, the inkjet recording apparatuses perform cleaning, or discharge bubbles or ink with increased viscosity from the nozzles of the recording head to a waste ink tank, when necessary for preventing ink ejection problems.

In the off-carriage type inkjet recording apparatuses, the waste ink tank may be formed integrally with the ink cartridge. A variety of such apparatuses have been proposed (see, for example, Patent Document No. 1).

As shown in FIG. 7, Patent Document No. 1 describes an inkjet recording apparatus 100 having an ink tank 102 for accommodating an ink pack 101. The ink pack 101 is connected to a recording head 105 through an ink supply tube 104 connected to an ink supply port 103 of the ink tank 102. The inkjet recording apparatus 100 further includes a cap 106 for receiving waste ink from the recording head 105. The cap 106 is connected to a pressurization port 109 of the ink tank 102 through an ink recovery tube 107 and a pump 108. A valve 112 and a pressure sensor 113 are connected to a discharge port 110 of the ink tank 102 through a passage 111. The valve 112 opens the ink tank 102 when necessary. The pressure sensor 113 detects the pressure in the ink tank 102. A stopper 114 is formed in the ink supply tube 104 for selectively prohibiting and permitting a flow of ink in the ink supply tube 104.

When the pump 108 is activated with the ink supply tube 104 held open by the stopper 114, the waste ink and the air are introduced from the cap 106 into the ink tank 102 through the ink recovery tube 107. This raises the pressure in the ink tank 102 and thus squeezes the ink pack 101, supplying the ink to the recording head 105 through the ink supply tube 104.

When the inkjet recording apparatus 100 operates to restore ink ejection performance, the stopper 114 blocks the ink supply tube 104 and the pump 108 is activated. When the pressure in the ink tank 102 reaches a predetermined level, the ink supply tube 114 is opened. This causes the ink to flow to the recording head 105 rapidly, thus removing the ink and the bubbles in the ink from a nozzle portion of the recording head 105. In this manner, the ink ejection performance is restored through pressurization.

In the inkjet recording apparatus 100, it is desired that the ink be supplied to the recording head 105 appropriately for performing printing effectively. It is thus necessary to maintain the ink pack 101 in an appropriately pressurized state.

Liquid ejection apparatuses are now required to be compact and gear pumps, which satisfy such requirement, are capturing attention.

However, if the inkjet recording apparatus 100 includes a gear pump and suction maintenance performance of the pump is lowered due to a manufacturing error in the pump, the air or the ink may flow back to the cap 106. This makes it difficult to maintain the ink pack 101 in an appropriately pressurized state. If backflow of the ink occurs, a mixture of the waste ink and the air leaks to the cap 106, generates bubbles in the cap 106, and thus contaminates the recording head 105.

Further, when the inkjet recording apparatus 100 seals the nozzles of the recording head 105 by means of the cap 106, the inkjet recording apparatus 100 forms a closed circulatory system. Therefore, if the pressure in the cap 106 and the pressure in the recording head 105 are not equilibrated, or the pressure in the cap 106 becomes higher than the pressure in the recording head 105, the air and the waste ink may flow back from the cap 106 to the recording head 105.

If the suction maintenance performance of the gear pump is relatively low, the air and the waste ink flow to the ink tank 102 when the gear pump is activated, with the nozzles of the recording head 105 sealed by the cap 106. However, if the gear pump stops, the air and the waste ink may flow back to the cap 106. Such air and waste ink may enter the recording head 105 through the nozzles of the recording head 105. This influences meniscus of the ink produced in the nozzles to a certain extent, thus hampering desirable ink ejection of the inkjet recording apparatus 100.

Patent Document No. 1: Japanese Laid-Open Patent Publication No. 2001-162838

SUMMARY OF THE INVENTION

Accordingly, it is an objective of the present invention to provide a liquid ejection apparatus capable of ejecting liquid reliably by suppressing backflow of the liquid and air.

To achieve the foregoing and other objectives, the invention provides a liquid ejection apparatus. The apparatus has a liquid ejection head for ejecting liquid, a cap member for receiving waste liquid discharged from the liquid ejection head, a waste liquid tank for retaining the waste liquid, and a gear pump for drawing the waste liquid from the cap member and introducing the waste liquid into the waste liquid tank. The apparatus further includes waste liquid backflow suppression means for suppressing backflow of the waste liquid to the cap member.

If the suction maintenance performance of the gear pump is lowered by, for example, a manufacturing error, the waste liquid flows back to the cap member through the gear pump when the gear pump is not operated. However, such backflow is suppressed by the backflow suppression means. This suppresses contamination of the liquid ejection head by the waste liquid flowing from the cap member as bubbles. Further, when the liquid ejection apparatus forms a closed circulatory system by sealing the liquid ejection head by means of the cap member, backflow of the waste liquid from the cap member to the liquid ejection head is suppressed. The meniscus of the liquid formed in the liquid ejection head is thus maintained. Accordingly, the liquid ejection apparatus is allowed to eject the liquid reliably.

The waste liquid backflow suppression means of the liquid ejection apparatus may be arranged between the waste liquid tank and the gear pump or the gear pump and the cap member. If the waste liquid backflow suppression means is arranged between the waste liquid tank and the gear pump, the waste liquid is introduced into the waste liquid tank through the waste liquid backflow suppression means after having been drawn by the gear pump. This allows the waste liquid backflow suppression means to suppress backflow of the waste liquid from the waste liquid tank.

If the waste liquid backflow suppression means is provided between the gear pump and the cap member, the waste liquid is drawn by the gear pump through the waste liquid backflow suppression means after having been received by the cap member. Therefore, in the two cases, even if the suction maintenance performance of the gear pump is relatively low, backflow of the waste liquid to the cap member is suppressed when the gear pump is not used. Particularly, if the waste liquid backflow suppression means is provided between the gear pump and the cap member, negative pressure acts entirely in the passage between the cap member and the waste liquid backflow suppression means when the gear pump is operated. Accordingly, when, for example, the cap member seals the nozzles, backflow of the waste liquid to the liquid ejection head through the cap member is further suppressed.

The waste liquid backflow suppression means of the liquid ejection apparatus may be formed by a valve device. The valve device suppresses backflow of the waste liquid from the waste liquid tank to the cap member. This allows the liquid ejection apparatus including the valve device to suppress contamination of the liquid ejection head by the waste liquid flowing from the cap member as bubbles. Further, when the liquid ejection apparatus forms a closed circulatory system, backflow of the waste liquid to the liquid ejection head is suppressed.

Another aspect of the invention is a liquid ejection apparatus including a liquid ejection head for ejecting liquid, a liquid retainer for retaining the liquid to be ejected and supplying the liquid to the liquid ejection head while being pressurized by pressurized air, and a gear pump for generating the pressurized air for pressurizing the liquid retainer. The apparatus further includes air backflow suppression means that permits supply of the pressurized air only to the liquid retainer.

In this aspect of the present invention, the air backflow suppression means restricts the supply of the pressurized air for supply to the liquid retainer. This suppresses backflow of the pressurized air from the liquid retainer, thus preventing a pressure drop in the liquid retainer. The liquid retainer is thus pressurized effectively and is allowed to supply the liquid to the liquid ejection head appropriately. This allows the liquid ejection apparatus to eject the liquid reliably. Further, if, for example, the liquid ejection apparatus forms a closed circulatory system, backflow of the pressurized air to the liquid ejection head is suppressed by preventing backflow of the pressurized air. The meniscus of the liquid formed in the liquid ejection head is thus maintained. Accordingly, the liquid ejection apparatus ejects the liquid reliably.

The air backflow suppression means may be arranged between the liquid retainer and the gear pump or upstream from the gear pump. If the air backflow suppression means is arranged between the liquid retainer and the gear pump, the pressurized air generated by the gear pump is supplied to the liquid retainer through the air backflow suppression means. The air backflow suppression means suppresses backflow of the pressurized air. This suppresses a pressure drop in the liquid retainer and allows the liquid retainer to supply the liquid to the liquid ejection head appropriately.

If the air backflow suppression means is provided upstream from the gear pump, upstream backflow of the pressurized air, which is generated by the gear pump and sent downstream from the gear pump, is suppressed. That is, even if the suction maintenance performance of the gear pump is lowered by a manufacturing error, backflow of the pressurized air is stopped. Accordingly, if the liquid ejection apparatus forms a closed circulatory system, for example, backflow of the pressurized air to the liquid ejection head is suppressed. Further, since the pressurized air does not return from the downstream side of the gear pump to the upstream side, a pressure drop in the liquid retainer is suppressed.

The air backflow suppression means may be formed by a valve device. The valve device permits supply of the pressurized air only to the liquid retainer. This allows the liquid ejection apparatus having the valve device to suppress a pressure drop of the pressurized air supplied to the liquid retainer. Further, if the liquid ejection apparatus forms a closed circulatory system, backflow of the pressurized air to the liquid ejection head is suppressed.

Another aspect of the invention is a liquid ejection apparatus having a liquid ejection head for ejecting liquid, a cap member for receiving the liquid ejected from the liquid ejection head as waste liquid, a gear pump for drawing the waste liquid and the air from the cap member, and a liquid retainer having a waste liquid retainer portion for retaining the waste liquid drawn by the gear pump and receiving the air as pressurized air, and a liquid retaining portion for retaining the liquid to be supplied to the liquid ejection head using the pressurized air. The apparatus further includes fluid backflow suppression means for suppressing backflow of the waste liquid and the pressurized air to the cap member.

The fluid backflow suppression means suppresses backflow of the pressurized air and the waste liquid to the cap member. Therefore, if the suction maintenance performance of the gear pump is relatively low, backflow of the waste liquid and the pressurized air to the cap member is suppressed when the gear pump is not operated. This suppresses a pressure drop of the pressurized air, allowing the liquid retainer to appropriately supply the retained liquid to the liquid ejection head using the pressurized air. Further, contamination of the liquid ejection head by the waste liquid and the pressurized air flowing from the cap member as bubbles is suppressed. Also, when, for example, the liquid ejection apparatus forms a closed circulatory system by sealing the liquid ejection head by means of the cap member, backflow of the pressurized air and the waste liquid to the liquid ejection head through the cap member is suppressed when the gear pump is not used. The meniscus of the liquid formed in the liquid ejection head is maintained. As a result, the liquid ejection apparatus ejects the liquid reliably.

The fluid backflow suppression means may be arranged between the liquid retainer and the gear pump or the gear pump and the cap member. If the fluid backflow suppression means is arranged between the liquid retainer and the gear pump, the waste liquid and the pressurized air are introduced into the waste liquid retainer portion of the liquid retainer through the fluid backflow suppression means after having been drawn from the cap member. Backflow of the waste liquid and the pressurized air from the waste liquid retainer portion to the gear pump is suppressed. Therefore, even if the suction maintenance performance of the gear pump is relatively low, contamination of the liquid ejection head by the waste liquid and the pressurized air flowing from the cap member as bubbles is further suppressed, when the gear pump is not used. A pressure drop of the pressurized air in the waste liquid retainer portion is also suppressed, thus allowing the liquid retainer portion of the liquid retainer to appropriately supply the liquid to the liquid ejection head using the pressurized air. If the fluid backflow suppression means is provided between the gear pump and the cap member, the gear pump draws the waste liquid and the air from the cap member through the fluid backflow suppression means. Therefore, when, for example, the liquid ejection apparatus forms a closed circulatory system by sealing the liquid ejection head by means of the cap member, backflow of the pressurized air and the waste liquid to the liquid ejection head through the cap member is further suppressed when the gear pump is not operated. This maintains the meniscus of the liquid formed in the liquid ejection head. Accordingly, the liquid ejection apparatus ejects the liquid reliably.

The fluid backflow suppression means may be formed by a valve device. The valve device suppresses backflow of the waste liquid and the pressurized air to the cap member. This allows the liquid ejection apparatus having the valve device to suppress contamination of the liquid ejection head by the waste liquid and the pressurized air flowing from the cap member as bubbles. Further, when, for example, the liquid ejection apparatus forms a closed circulatory system by sealing the liquid ejection head by means of the cap member, backflow of the pressurized air and the waste liquid to the liquid ejection head is suppressed.

The valve device may include an inlet portion into which at least one of the waste liquid or the pressurized air is introduced, an outlet portion through which the waste liquid or the pressurized air flows from the inlet portion to the exterior, and a valve body for connecting the inlet portion and the outlet portion to each other if pressure of the pressurized air is not less than a predetermined reference level and disconnecting the inlet portion from the outlet portion if the waste liquid and the pressurized air return from the outlet portion to the inlet portion.

If the waste liquid and the pressurized air flow back, the valve body disconnects the inlet portion from the outlet portion. The waste liquid is thus introduced into the waste liquid tank or the waste liquid retainer portion, and backflow of the waste liquid is suppressed. This suppresses contamination of the liquid ejection head by the waste liquid flowing from the cap member. Further, by disconnecting the inlet portion from the outlet portion, a pressure drop in the liquid retainer is suppressed. The liquid retainer is thus allowed to appropriately supply the liquid to the liquid ejection head. Accordingly, the liquid ejection apparatus ejects the liquid reliably.

The valve body of the valve device may be configured to connect the inlet portion and the outlet portion to each other if the difference between the pressure in the inlet portion and the pressure in the outlet portion exceeds a predetermined reference value, and to disconnect the inlet portion from the outlet portion if the difference between the pressure in the inlet portion and the pressure in the outlet portion is equal to or smaller than the reference value. If, for example, the gear pump is not operated for a relatively long time, the pressure in the outlet portion may be lowered to the atmospheric pressure due to slight leakage of the pressurized air, thus eliminating the difference between the pressure in the inlet portion and the pressure in the outlet portion. Even in this state, the inlet portion and the outlet portion are maintained in a state disconnected from each other. This prevents the waste liquid and the pressurized air from flowing back when the liquid ejection apparatus is moved.

Further, if, for example, the gear pump is not operated and the pressure in the outlet portion rises, or backflow of the waste liquid and the pressurized air is likely to happen, the valve body disconnects the inlet portion from the outlet portion. That is, the valve device prevents the waste liquid and the pressurized air from flowing back when the gear pump is not used. Accordingly, the liquid ejection apparatus including the gear pump suppresses contamination of the liquid ejection head by the waste liquid flowing from the cap member as bubbles. Further, by disconnecting the inlet portion from the outlet portion, a pressure drop in the liquid retainer is stopped from occurring. The liquid retainer is thus effectively pressurized and allowed to appropriately supply the liquid to the liquid ejection head. Further, when the liquid ejection apparatus forms a closed circulatory system, backflow of the waste liquid and the pressurized air to the liquid ejection head is suppressed. As a result, the liquid ejection apparatus is allowed to eject the liquid reliably.

DESCRIPTION OF THE PREFERRED EMBODIMENTS

First Embodiment

A first embodiment of the present invention will now be described with reference to FIGS. 1 to 4.

Figure 1:
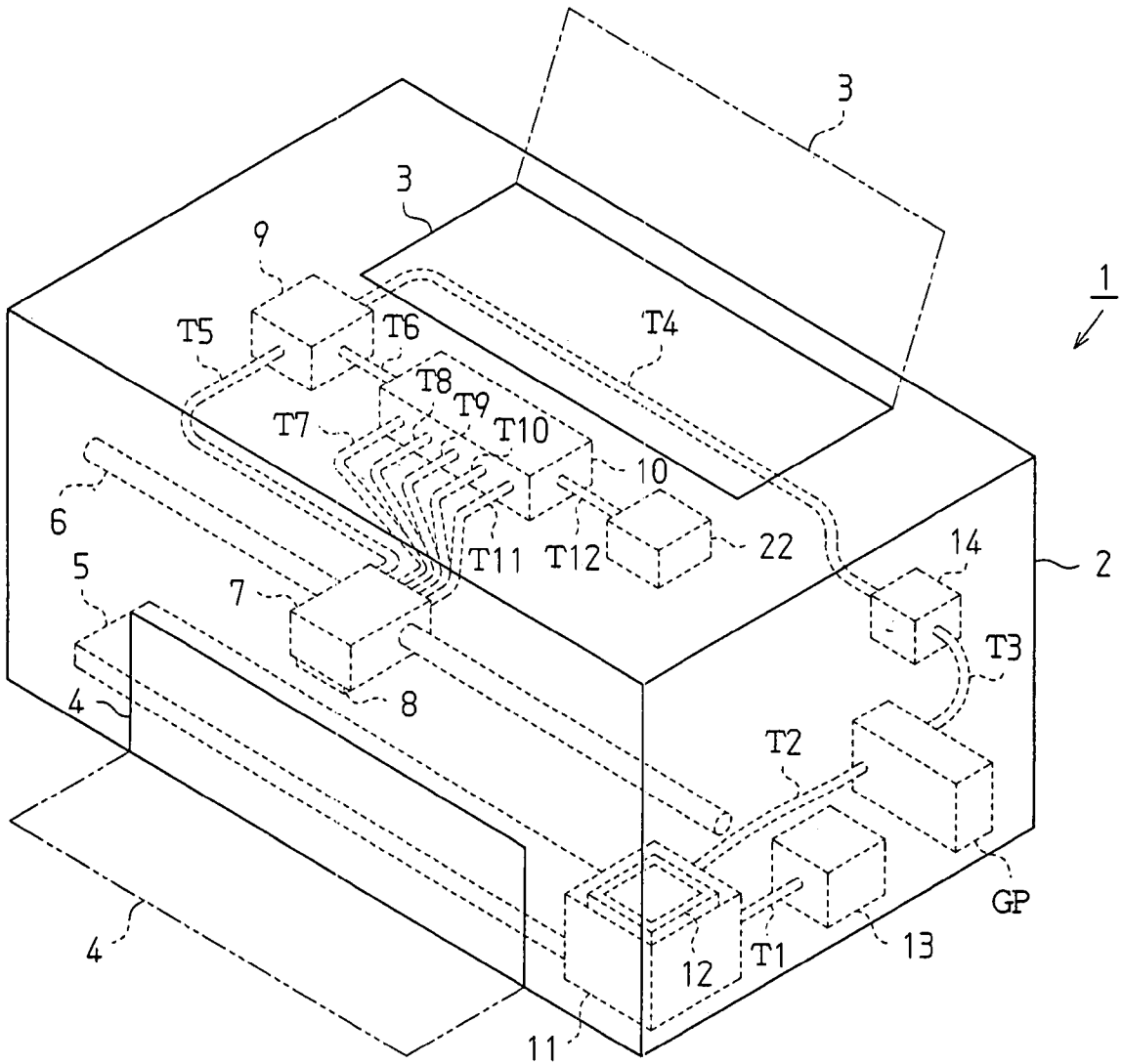
[FIG. 1] A perspective view schematically showing a printer according to a first embodiment of the present invention.

As shown in FIG. 1, a printer 1 serving as a liquid ejection apparatus includes a substantially parallelepiped frame 2. A paper feed tray 3 is formed on an upper surface of the frame 2 and a paper outlet tray 4 is provided on a front surface of the frame 2. The paper feed tray 3 and the paper outlet tray 4 are each configured in such a manner as to be received in the frame 2 in a state folded by means of a non-illustrated hinge mechanism.

A platen 5 extends longitudinally in the frame 2. A recording paper is inserted into the frame 2 through the paper feed tray 3 and supplied to the platen 5 by a non-illustrated paper feed mechanism. The recording paper is then sent from the frame 2 to the exterior through the paper outlet tray 4.

A guide member 6 is provided in the frame 2 and extends parallel with the platen 5. A carriage 7 is supported by the guide member 6 with the guide member 6 passed through the carriage 7. The carriage 7 is movable along the guide member 6. A carriage motor (not shown) is secured to the frame 2. The carriage 7 is operably connected to the carriage motor through a timing belt (not shown) wound around a pair of pulleys (not shown). When the carriage motor runs, the drive force generated by the carriage motor is transmitted to the carriage 7 through the timing belt. As powered by the carriage motor, the carriage 7 reciprocates along the guide member 6 and parallel with the platen 5 (in a main scanning direction).

A recording head 8 serving as a liquid ejection head is formed on the lower surface of the carriage 7 (opposed to the platen 5). The recording head 8 includes a nozzle surface 8*a* (see FIG. 2) opposed to the recording paper. The nozzle surface 8*a* includes six nozzle lines (not shown), each of which includes nozzles N (FIG. 2) provided in a number n (n is a natural number). The number of the nozzles N formed in each of the nozzle lines and the number of the nozzle lines may be modified as necessary.

A first ink cartridge 9 and a second ink cartridge 10 are provided in the frame 2 as liquid containers. The first and second ink cartridges 9, 10 supply ink, as liquid, of colors corresponding to the nozzles (in the first embodiment, black, cyan, magenta, yellow, light cyan, and light magenta) to the recording head 8. The ink is then pressurized by piezoelectric elements 8*b* (FIG. 2) and ejected from the corresponding nozzles N of the recording head 8 as ink droplets. The ink droplets produce dots of black, cyan, magenta, yellow, light cyan, or light magenta on the recording paper.

In the printer 1, a zone in which the carriage 7 is reciprocated for ejecting the ink droplets to the recording paper for carrying out printing is defined as a printing zone. Further, a non-printing zone is defined in the printer 1 for sealing the nozzles N when printing is not performed. As shown in FIG. 1, a cap holder 11 is formed in the non-printing area.

Figure 2:
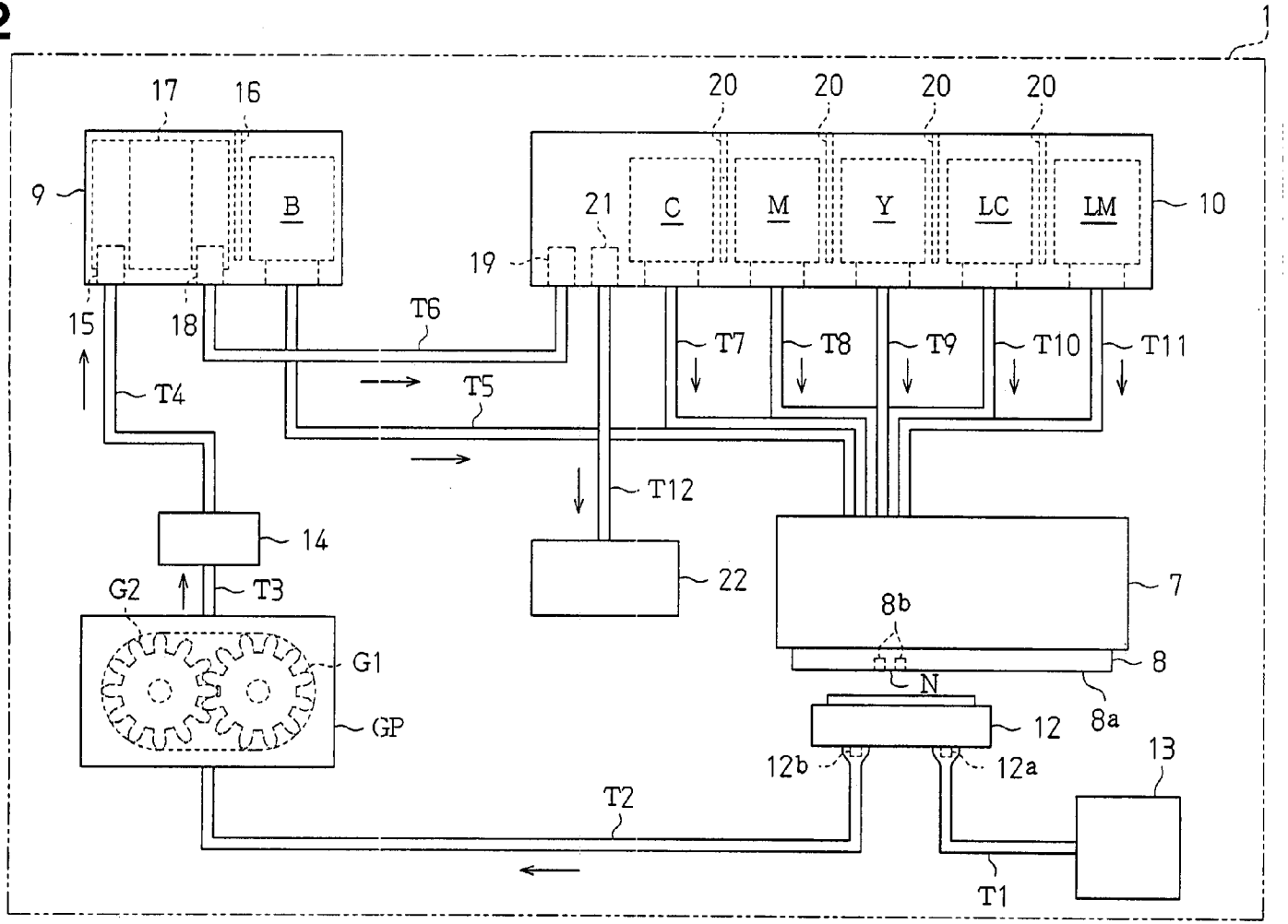
[FIG. 2] A block diagram representing an ink supply system for a recording head.

A cap member 12 is provided in the cap holder 11 as opposed to the nozzle surface 8*a* of the recording head 8. The cap holder 11 raises the cap member 12 through a non-illustrated drive mechanism in such a manner that the cap member 12 tightly contacts the nozzle surface 8*a* and thus seals the nozzles N of the recording head 8. As shown in FIG. 2, a first communication port 12*a* and a second communication port 12*b* are defined in the bottom of the cap member 12 and communicate with the interior of the cap member 12. A cap opening valve 13 is connected to the first communication port 12*a* through a tube T1. When necessary, the cap opening valve 13 opens the space defined by the cap member 12 and the nozzle surface 8*a* that are held in tight contact with each other. The second communication port 12*b* is connected to a suction port (not shown) of a gear pump GP through a tube T2. The gear pump GP includes gears G1, G2. The gears G1, G2 are rotated by drive force transmitted from a non-illustrated drive motor, thus applying negative pressure to the cap member 12. When the cap opening valve 13 is closed and the cap member 12 seals the nozzle surface 8*a*, the nozzles N are cleaned by applying the negative pressure to the nozzles N of the nozzle surface 8*a* by means of the gear pump GP.

A check valve 14 is connected to the discharge port (not shown) of the gear pump GP through a tube T3. A fluid inlet member 15 of the first ink cartridge 9 is connected to the check valve 14 through a tube T4.

The first ink cartridge 9 has two retainer portions defined by a partition 16. One of the retainer portions receives an ink pack B that retains black ink and the other receives an ink absorption body 17 that absorbs ink. The ink pack B is connected to the recording head 8 of the carriage 7 through a tube T5. The ink absorption body 17 is formed of water-absorbent porous material such as sponge.

Therefore, the waste ink and the air are drawn by the gear pump GR and flow from the cap member 12 to the first ink cartridge 9 through the fluid inlet member 15. The waste ink is then absorbed by the ink absorption body 17 in the first ink cartridge 9. The check valve 14 prevents the waste ink from returning to the cap member 12.

An air inlet member 19 of the second ink cartridge 10 is connected to an air outlet member 18 of the first ink cartridge 9 through a tube T6. The first ink cartridge 9 and the second ink cartridge 10 thus communicate with each other. The second ink cartridge 10 includes a plurality of retainer portions defined by corresponding partitions 20. Each of the retainer portions retains one of ink packs C, M, Y, LC, and LM that respectively contain color inks of cyan, magenta, yellow, light cyan, and light magenta. The ink packs C, M, Y, LC, and LM are connected to the recording head 8 of the carriage 7 through the tubes T7, T8, T9, T10, and T11, respectively. An opener device 22 is connected to the air outlet member 21 of the second ink cartridge 10 through a tube T12 for opening the second ink cartridge 10 when necessary.

Accordingly, when the gear pump GP is activated, the waste ink and the air are drawn from the cap member 12 and thus flow into the cap member 12, the tube T2, the gear pump GP, the tube T3, the check valve 14, and the tube T4 in this order. The waste ink and the air are then introduced into the first ink cartridge 9. At this stage, the waste ink is absorbed by the ink absorption body 17. Therefore, only the air (hereinafter, the "pressurized air") moves in the first ink cartridge 9. The pressurized air then flows from the first ink cartridge 9 to the second ink cartridge 10 through the tube T6 and is retained by the opener device 22, which is connected to the tube T12.

In other words, the air pressure in the first ink cartridge 9 and the air pressure in the second ink cartridge 10 are maintained constantly equal without becoming unequilibrated between each other. Therefore, when the gear pump G is activated, the ink packs B, C, M, Y, LC, and LM in the first and second ink cartridges 9, 10 are pressurized by the pressurized air. This causes the ink of the ink packs B, C, M, Y, LC, and LM to flow to the recording head 8 of the carriage 7.

That is, in the first embodiment, the gear pump GP of the printer 1 functions as a cleaning pump for applying negative pressure to the cap member 12 and a pressurization pump for pressurizing the ink packs B, C, M, Y, LC, and LM. Accordingly, when the gear pump GP is activated, the gear pump GP applies negative pressure to the cap member 12 for drawing the waste ink and the air and pressurizes the ink packs B, C, M, Y, LC, and LM for sending the ink to the recording head 8.

The configuration of the check valve 14 will now be described in detail, referring to FIGS. 3 and 4.

Figure 3:
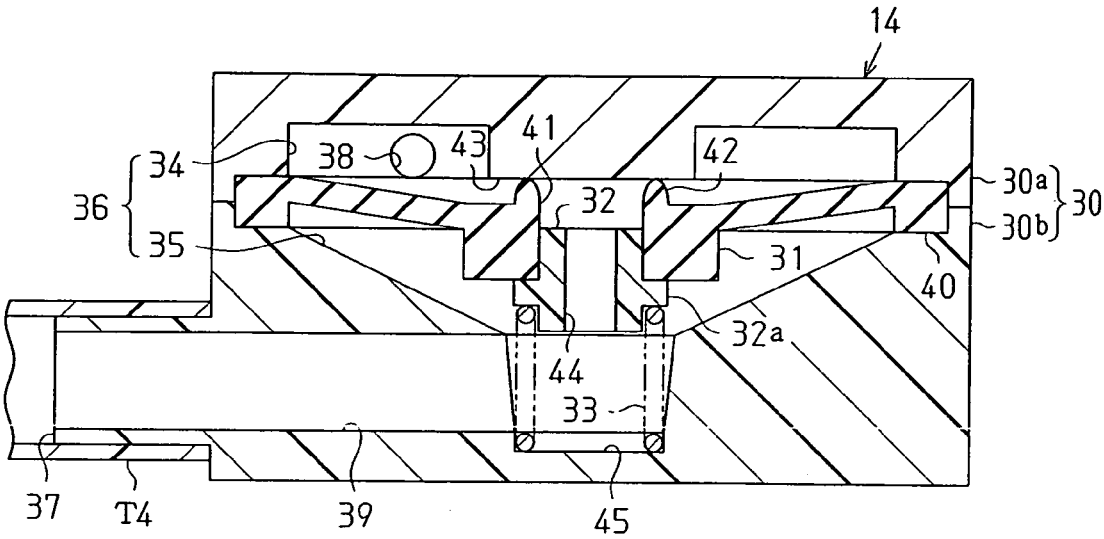
[FIG. 3] A cross-sectional view showing the structure of a check valve.
Figure 4A:
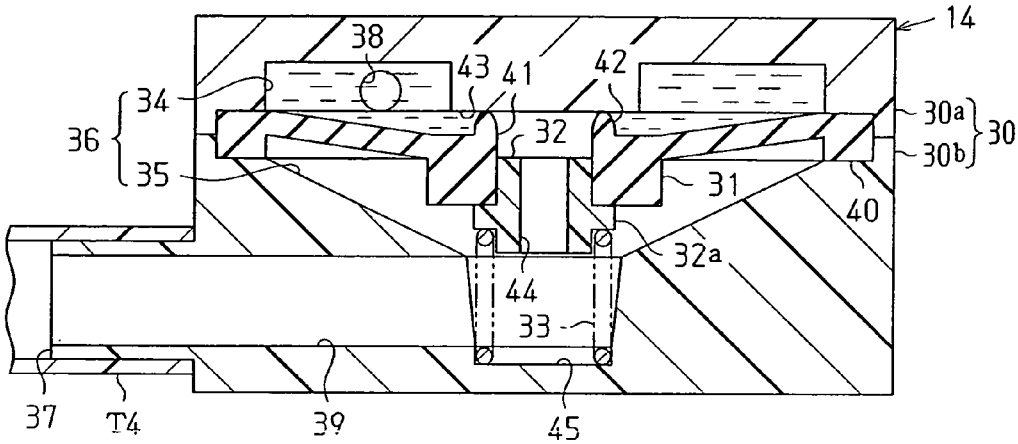
[FIGS. 4 (*a*), (*b*), and (*c*)] Cross-sectional views each showing an operational state of the check valve.
Figure 4B:
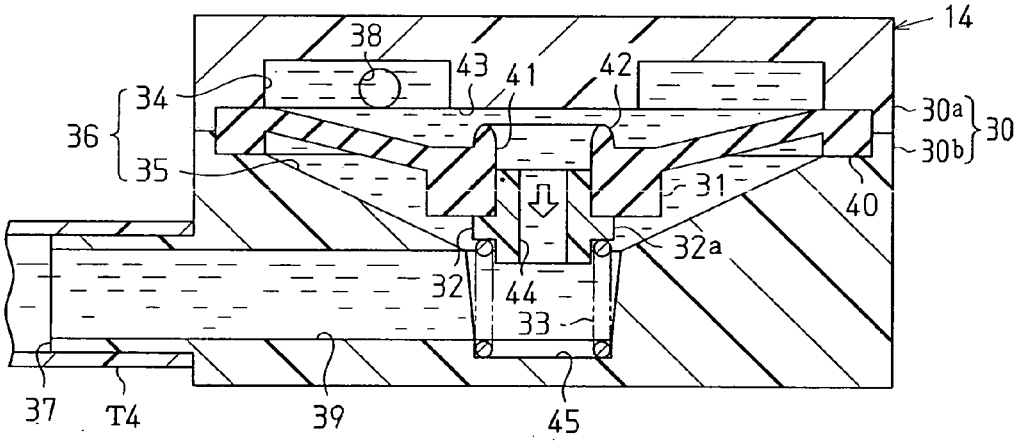
Figure 4C:
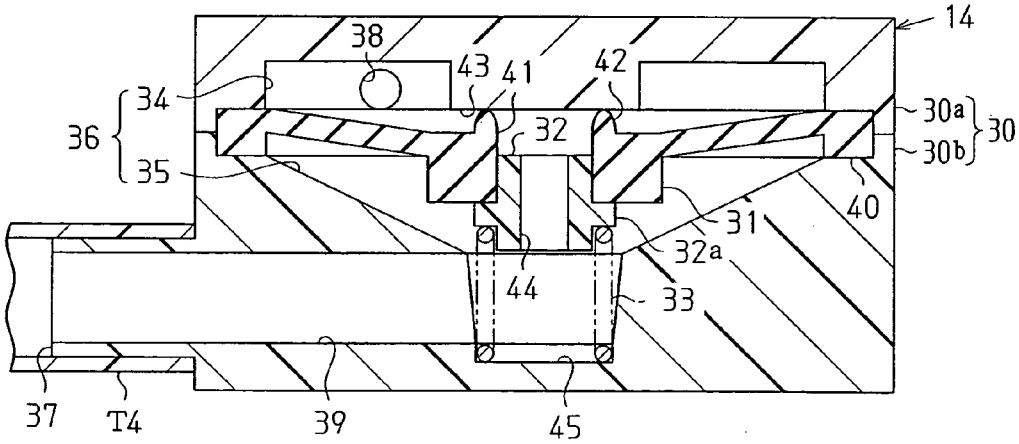

As shown in FIG. 3, the check valve 14 includes a body casing 30, a diaphragm portion 31, a support member 32, and a spring member 33. The body casing 30 has an upper casing section 30*a* and a lower casing section 30*b*. An upstream valve chamber portion 34 is defined in the upper casing section 30*a* in an annular shape. A downstream valve chamber portion 35 is defined in the lower casing section 30*b* in a funnel-like shape. With the upper casing section 30*a* and the lower casing section 30*b* joined together, a valve chamber 36 is defined in the body casing 30.

An attachment hole (not shown) for attaching the tube T3 and an attachment hole 37 for attaching the tube T4 are defined in the body casing 30 of the check valve 14. The attachment hole for the tube T3 communicates with the upstream valve chamber portion 34 through a first passage 38 defined in the body casing 30 (the upper casing section 30*a*). The attachment hole 37 for the tube T4 communicates with the downstream valve chamber portion 35 through a second passage 39 defined in the body casing 30 (the lower casing section 30*b*). This structure allows the waste ink and the air to flow from the gear pump GP to the valve chamber 36 (the upstream valve chamber portion 34 and the downstream valve chamber portion 35) through the tube T3 and the first passage 38. The waste ink and the air then flow from the valve chamber 36 to the first ink cartridge 9 through the second passage 39 and the tube T4.

The diaphragm portion 31 is formed of flexible material such as rubber in a disk-like shape. For assembling the check valve 14, the diaphragm portion 31 is received in the valve chamber 36 with an outer circumferential end 40 of the diaphragm portion 31 held fixedly between the upper and lower casing sections 30*a*, 30*b* of the body casing 30. The diaphragm portion 31 thus separates the upstream valve chamber portion 34 from the downstream valve chamber portion 35 in the valve chamber 36. This arrangement allows an intermediate portion of the diaphragm portion 31 to reciprocate upward and downward (toward the upstream valve chamber portion 34 and the downstream valve chamber portion 35), as viewed in FIG. 3. A communication hole 41 extends through the intermediate portion of the diaphragm portion 31. The upstream and downstream valve chamber portions 34, 35 communicate with each other through the communication hole 41. An annular projection 42 is formed around the communication hole 41 (in the upstream valve chamber portion 34). A columnar contact portion 43 projects from the upper casing section 30*a* as opposed directly to the projection 42. While held in tight contact with the projection 42, the contact portion 43 blocks the communication hole 41. The contact portion 43 is formed in the columnar shape by removing a portion of the upper casing section 30*a* corresponding to the upstream valve chamber portion 34. This structure allows the upstream and downstream valve chamber portions 34, 35 to communicate with each other when the diaphragm 31 deforms downward (toward the downstream valve chamber portion 35) and thus the projection 42 separates from the contact portion 43. In contrast, when the diaphragm 31 deforms upward (toward the upstream valve chamber portion 34) and thus the projection 42 contacts the contact portion 43, the upstream valve chamber portion 34 is disconnected from the downstream valve chamber portion 35.

The support member 32 having a cylindrical shape is fitted into the communication hole 41 of the diaphragm portion 31, from the side corresponding to the downstream valve chamber portion 35. The support member 32 is integrated with the diaphragm portion 31. When the support member 32 is urged by the spring member 33, the support member 32 deforms the diaphragm portion 31 upward (toward the upstream valve chamber portion 34) from the downstream valve chamber portion 35. A through hole 44 is defined by the space surrounded by the support member 32 and communicates with the communication hole 41. A projection 32*a* projects from an outer side surface of the support member 32 and an upper side (an end closer to the upstream valve chamber portion 34) of the projection 32*a* contacts the diaphragm portion 31. This structure allows the support member 32 to be positioned with respect to the diaphragm portion 31 as fitted in the diaphragm portion 31.

A circular recess 45 is defined in the bottom of the downstream valve chamber portion 35 as opposed to the support member 32. The spring member 33 engages the wall of the recess 45 and the outer circumferential surface of the support member 32 and contacts the projection 32*a*. The spring member 33 is thus received in the downstream valve chamber portion 35. The spring member 33 urges the diaphragm portion 31 upward (toward the upstream valve chamber portion 34) through the support member 32. If the difference between the pressure in the upstream valve chamber portion 34 and the pressure in the downstream valve chamber portion 35 is equal to or smaller than a reference value, the spring member 33 deforms the diaphragm, portion 31 in such a manner as to cause the projection 42 to contact the contact portion 43. Contrastingly, if the difference between the pressure in the upstream valve chamber portion 34 and the pressure in the downstream valve chamber portion 35 is greater than the reference value, the spring member 33 is deformed downward (toward the downstream valve chamber portion 35) against the pressure received from the upstream valve chamber portion 34 through the diaphragm portion 31.

Accordingly, if the difference between the pressure in the upstream valve chamber portion 34 and the pressure in the downstream valve chamber portion 35 is equal to or smaller than the reference value, the projection 42 of the diaphragm portion 31 contacts the contact portion 43, as shown in FIG. 3. In this state, the check valve 14 disconnects the upstream valve chamber portion 34 from the downstream valve chamber portion 35, thus stopping the corresponding flow of the waste ink and the air. If the waste ink and the air flow from the gear pump GP to the check valve 14 in this state, the waste ink is introduced into the upstream valve chamber portion 34 and the upstream valve chamber portion 34 is filled with the waste ink, as shown in FIG. 4(*a*). This increases the pressure in the upstream valve chamber portion 34, and thus the difference between the pressure in the upstream valve chamber portion 34 and the pressure in the downstream valve chamber portion 35 is increased to exceed the reference value. The check valve 14 then separates the projection 42 from the contact portion 43, as shown in FIG. 4(*b*). This allows the upstream and downstream valve chamber portions 34, 35 to communicate with each other, permitting the flow of the waste ink and the air from the upstream valve chamber portion 34 to the downstream valve chamber portion 35. Meanwhile, the waste ink and the air sent from the gear pump GP to the check valve 14 through the tube T3 flow in the first passage 38, the upstream valve chamber portion 34, the communication hole 41, the through hole 44, the downstream valve chamber portion 35, the second passage 39, and the tube T4 in this order. The waste ink and the air then flow into the first ink cartridge 9. When the gear pump GP is stopped and the flow of the waste ink and the air into the first passage 38 is suspended, as illustrated in FIG. 4(*c*), the pressure in the upstream valve chamber portion 34 is lowered and the difference between the pressure in the upstream valve chamber portion 34 and the pressure in the downstream valve chamber portion 35 becomes equal to or smaller than the reference value. At this stage, the diaphragm portion 31 is deformed upward (toward the upstream valve chamber portion 34) by the spring member 33 and urged upward by the waste ink in the downstream valve chamber portion 35. This causes the projection 42 of the diaphragm portion 31 to contact the contact portion 43, thus disconnecting the upstream valve chamber portion 34 from the downstream valve chamber portion 35. The corresponding flow of the waste ink and the air is thus stopped. This prevents the waste ink and the air from returning from the downstream valve chamber portion 35 to the upstream valve chamber portion 34. The waste ink and the air thus do not flow to the gear pump GP.

AS has been described, the check valve 14 opens for allowing the waste ink and the air to flow into the first ink cartridge 9 only when the difference between the pressure in the upstream valve chamber portion 34 and the pressure in the downstream valve chamber portion 35 caused by such flow is greater than the reference value. That is, the printer 1 of the first embodiment allows the waste ink and the air to flow from the gear pump GP to the first ink cartridge 9 through the check valve 14, sending the air to the second ink cartridge 10 as the pressurized air. The first and second ink cartridges 9, 10 are thus supplied with the pressurized air the pressure of which is not less than a reference level. The reference level of the pressure corresponds to a value predetermined for effectively pressurizing the ink packs B, C, M, Y, LC, and LM.

Further, the waste ink and the air flowing to the first ink cartridge 9 through the check valve 14 are prevented from flowing back. This suppresses contamination of the recording head 8, unlike the conventional liquid ejection apparatus. Also, a pressure drop of the pressurized air flowing in the first and second ink cartridges 9, 10 is suppressed.

The operation of the check valve 14 will hereafter be described.

When the gear pump GP of the printer 1 is activated, the gear pump GP draws the waste ink and the air from the cap member 12. The waste ink and the air thus flow in the cap member 12, the tube T2, the gear pump GP, the tube T3, the check valve 14, and the tube T4 in this order, and is introduced into the first ink cartridge 9. The air is then sent from the first ink cartridge 9 to the second ink cartridge 10 as the pressurized air for pressurizing the ink packs B, C, M, Y, LC, and LM. More specifically, by supplying the air (the pressurized air) to the first and second ink cartridges 9, 10 through the check valve 14, the ink packs B, C, M, Y, LC, and LM are pressurized by the pressurized air the pressure of which is not less than the reference level. Also, a pressure drop of the pressurized air is suppressed. As pressurized, the ink packs B, C, M, Y, LC, and LM send the ink of the corresponding colors to the recording head 8, and printing is performed reliably.

The first embodiment has the following advantages.

(1) In the first embodiment, the check valve 14 is configured in such a manner as to prevent the waste ink and the air from returning from the downstream valve chamber portion 35 to the upstream valve chamber portion 34. This suppresses backflow of the waste ink and the air to the gear pump GP. Therefore, unlike the conventional liquid ejection apparatus, contamination of the recording head 8 is suppressed. Further, a pressure drop of the pressurized air flowing in the first and second ink cartridges 9, 10 is suppressed and the pressure of such air is maintained effectively. Printing is thus performed reliably.

(2) In the first embodiment, the check valve 14 becomes open only if the waste ink and the air flow to the check valve 14. Accordingly, even if the printer 1 has been unused for a relatively long time and the pressure in the downstream valve chamber portion 35 corresponds to the atmospheric pressure, the upstream and downstream valve chamber portions 34, 35 are maintained in a state disconnected from each other. This prevents the ink backflow to the cap member 12 when, for example, the printer 1 is moved.

Second Embodiment

A second embodiment of the present invention will hereafter be described with reference to FIGS. 5 and 6.

In the second embodiment, a check valve suppresses backflow of the waste ink and the air to the cap member 12, like the check valve 14 of the first embodiment. The check valve of the second embodiment is different from the check valve 14 of the first embodiment in terms of the installation position with respect to the frame 2 of the printer 1. The configuration of the check valve of the second embodiment is thus modified correspondingly. Therefore, the following description focuses on the difference between the first embodiment and the second embodiment. Same or like reference numerals are given to parts of the second embodiment that are the same as or like corresponding parts of the first embodiment.

Figure 5:
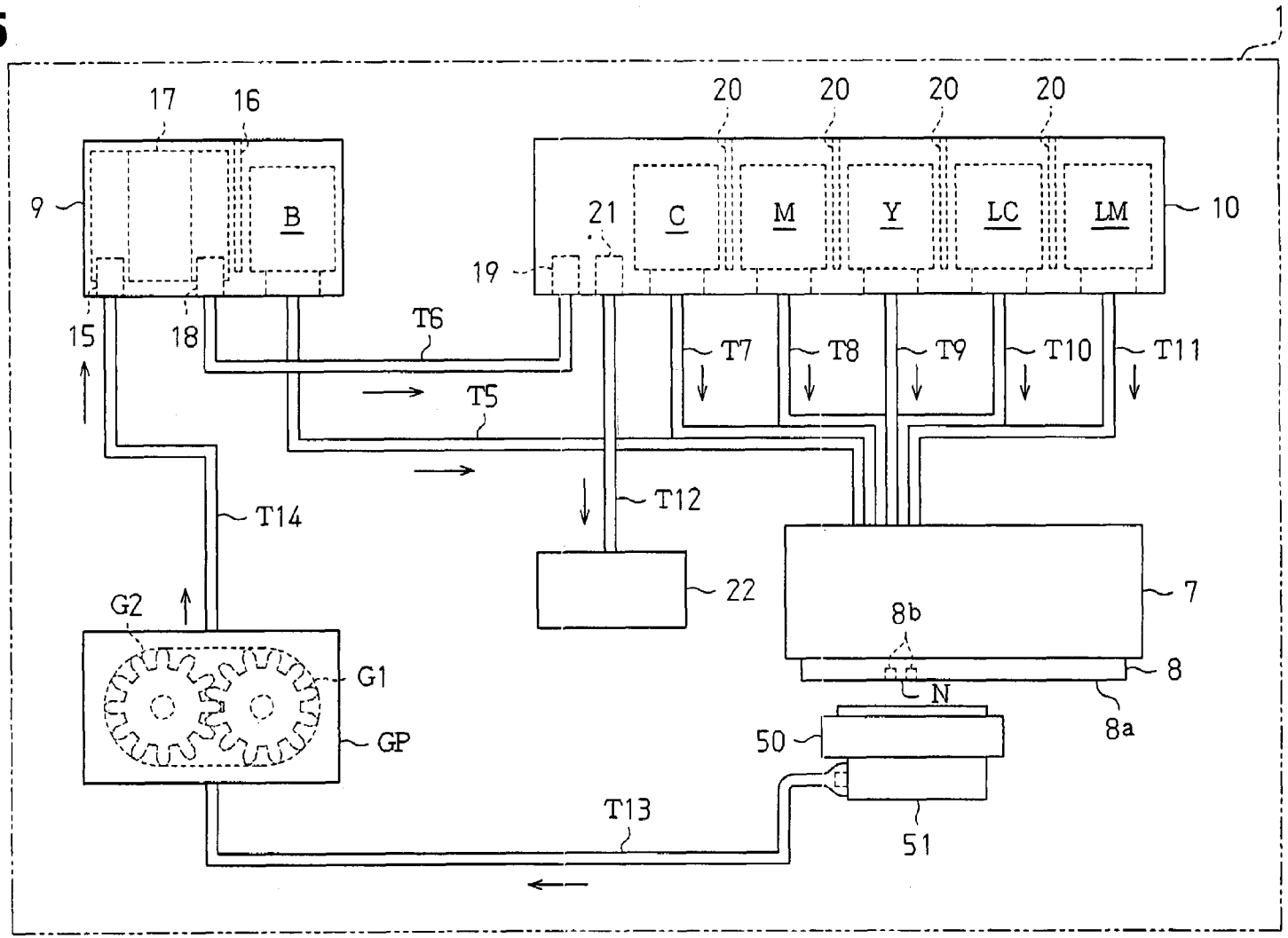
[FIG. 5] A block diagram showing an ink supply system for a recording head according to a second embodiment of the present invention.

As shown in FIG. 5, the gear pump GP is connected to a cap member 50 through a check valve 51 and a tube T13. The first ink cartridge 9 is connected to the gear pump GP through a tube T14. Like the first embodiment, the nozzles N of the nozzle surface 8*a* are subjected to cleaning by activating the gear pump GP with the nozzle surface 8*a* sealed by the cap member 50 for applying negative pressure to the nozzles N. The waste ink discharged in such cleaning, as well as the air, flows in the cap member 50, the check valve 51, the tube T13, the gear pump GP, and the tube T14 in this order. The waste ink and the air are then introduced into the first ink cartridge 9, like the first embodiment. Further, the air is sent from the first ink cartridge 9 to the second ink cartridge 10 as the pressurized air. This pressurizes the ink packs B, C, M, Y, LC, and LM of the first and second ink cartridges 9, 10, thus supplying the ink to the recording head 8. In cleaning, the ink supplied to the recording head 8 is discharged from the nozzles N of the recording head 8 to the cap member 50. That is, as long as the cap member 50 seals the nozzle surface 8*a*, the printer 1 forms a closed circulatory system.

Since the check valve 51 is provided in the second embodiment, the check valve 14 between the gear pump GP and the first ink cartridge 9 is not provided.

Figure 6:
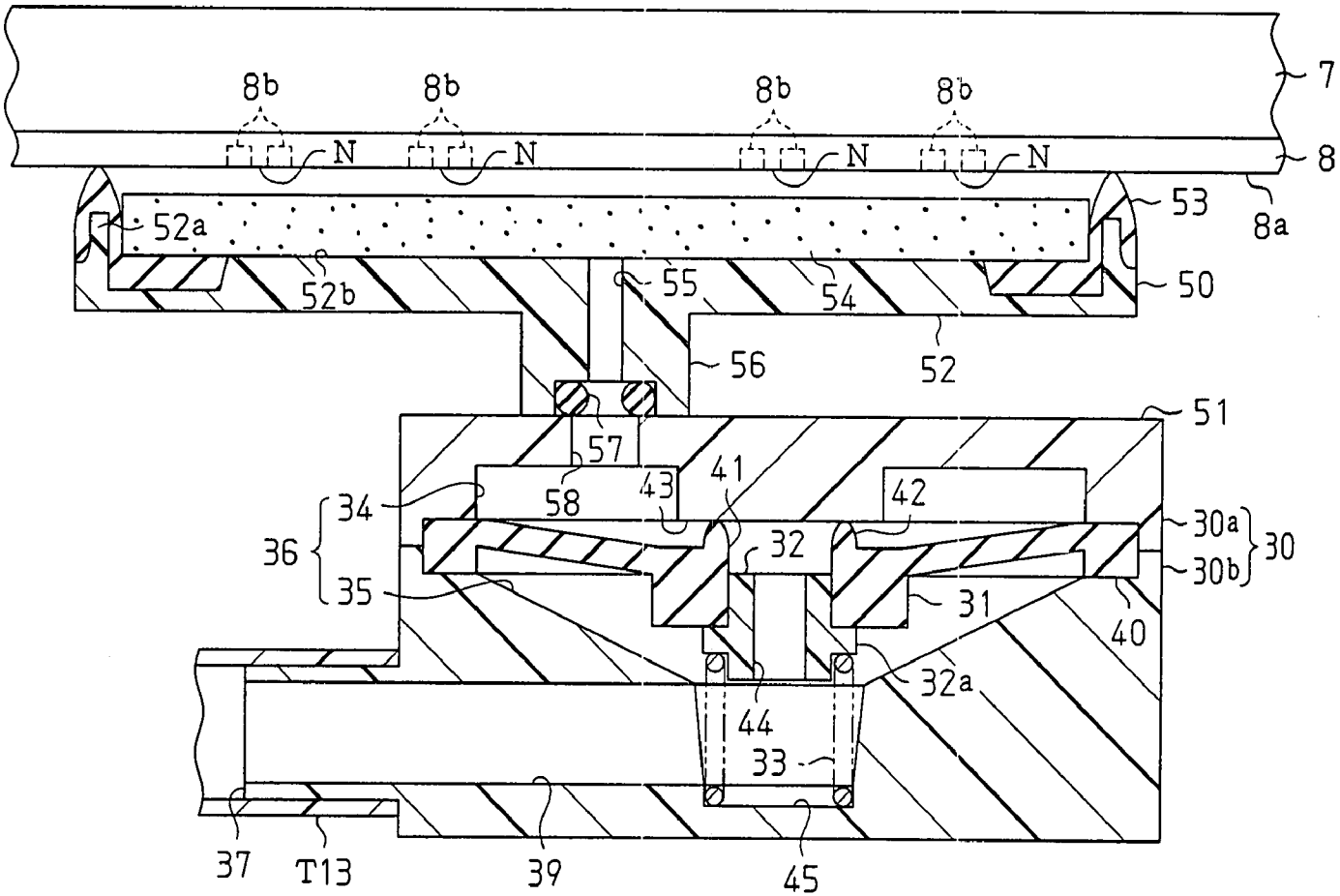
[FIG. 6] A cross-sectional view showing the structure of a cap member and the structure of a check valve.
Figure 7:
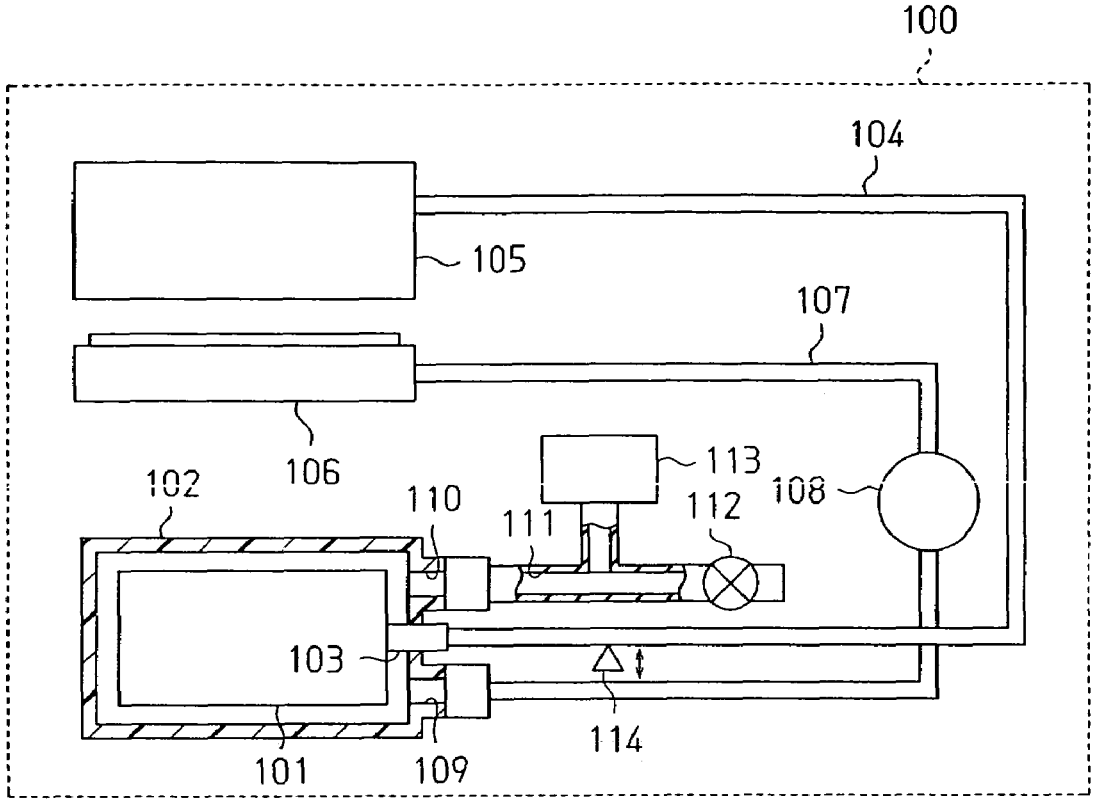
[FIG. 7] A block diagram schematically showing a prior art liquid ejection apparatus.

The configuration of the cap member 50 and the configuration of the check valve 51 will hereafter be explained in detail, referring to FIG. 6.

As shown in FIG. 6, the check valve 51 is secured to the bottom of the cap member 50 in such a manner that the check valve 51 forms one body with the cap member 50. The cap member 50 includes a casing 52, a seal portion 53, and an ink absorption body 54. The casing 52 is formed in a thin box-like shape, defining a rectangular shape in such a manner as to cover the nozzles N of the nozzle surface 8*a*, as viewed from above. An opening 52*a* is defined in the upper surface (opposed to the nozzle surface 8*a*) of the casing 52. The seal portion 53 is formed around the opening 52*a* in a projecting manner. The seal portion 53 tightly contacts the nozzle surface 8*a* and is formed of flexible material such as elastomer. Like the first embodiment, the cap member 50 seals the nozzles N by holding the seal portion 53 in tight contact with the nozzle surface 8*a* for covering the nozzle surface 8*a* by means of the seal portion 53 and the casing 52.

A communication hole 55 extends through the bottom 52*b* of the casing 52 and is defined continuously with a cylindrical outlet portion 56 projecting from the bottom of the cap member 50. The cap member 50 is connected to the check valve 51 through the outlet portion 56. The interior of the cap member 50 thus communicates with the interior of the check valve 51 through the communication hole 55. A ring 57 formed of flexible material such as rubber is fitted in an end of the outlet portion 56 closer to the check valve 51. When the cap member 50 and the check valve 51 are joined together, the ring 57 prevents the waste ink and the air from leaking from the joint portion. The ink absorption body 54 formed of a porous body such as a sponge is inserted into the casing 52 of the cap member 50 through the opening 52*a* and thus received in the casing 52. The ink absorption body 54 absorbs and retains the ink discharged from the nozzles N of the recording head 8 and sends the ink to the check valve 51 through the communication hole 55, as needed.

A communication hole 58 extends through the upper surface (opposed to the cap member 50) of the upper casing section 30*a* of the check valve 51. With the cap member 50 joined with the check valve 51, the communication hole 58 connects the interior of the cap member 50 to the upstream valve chamber portion 34 through the communication hole 55. In the second embodiment, the tube T13 is connected to the attachment hole 37 of the check valve 51.

Accordingly, the waste ink and the air are allowed to flow from the cap member 50 to the tube T13 via the upstream and downstream valve chamber portions 34, 35 of the check valve 51.

More specifically, like the first embodiment, if the gear pump GP is activated and the difference between the pressure in the upstream valve chamber portion 34 and the pressure in the downstream valve chamber portion 35 exceeds the reference value, the upstream and downstream valve chamber portions 34, 35 are connected to each other. The pressurized air is thus sent to the first and second ink cartridges 9, 10. That is, although the check valve 51 of the second embodiment is located upstream from the gear pump GP (closer to the cap member 50), the pressurized air the pressure of which is not less than the reference level is supplied to the first and second ink cartridges 9, 10, as in the first embodiment. This pressurizes the ink packs B, C, M, Y, LC, and LM effectively, thus supplying the ink of the corresponding colors to the recoding head 8. Printing is thus performed reliably. As has been described for the first embodiment, the reference level of the pressure corresponds to the value predetermined for pressurizing the ink packs B, C, M, Y, LC, and LM effectively.

Further, like the check valve 14 of the first embodiment, the check valve 51 prevents the ink from returning from the downstream valve chamber portion 35 to the upstream valve chamber portion 34, or from the gear pump GP to the cap member 50. Therefore, even if the cap member 50 seals the nozzle surface 8*a* for cleaning the nozzle surface 8*a* and thus the printer 1 forms a closed circulatory system, backflow of the waste ink and the air to the nozzles N through the cap member 50 is suppressed. The meniscus of the ink formed in the nozzles N is thus maintained, and ink ejection is performed effectively by the nozzles N. Therefore, printing is executed further reliably. Also, like the first embodiment, a pressure drop of the pressurized air flowing in the first and second ink cartridges 9, 10 is suppressed and the pressure of the air is maintained effectively.

The present invention is not restricted to the illustrated embodiments but may be modified as follows.

Although the cap member 50 and the opener valve 13 are not connected to each other in the second embodiment, the two components may be connected to each other. In this case, it is desired that the configuration of the cap member 50 be modified as needed.

In the first embodiment, the check valve 14 is arranged between the gear pump GP and the first ink cartridge 9 by connecting the check valve 14 to the tubes T3, T4. However, the check valve 14 may be provided between the first and second ink cartridges 9, 10 by connecting the check valve 14 to the tube T6. This allows the check valve 14 to supply the pressurized air the pressure of which is not less than the reference level to the second ink cartridge 10 further reliably.

In the illustrated embodiments, the first ink cartridge 9 and the second ink cartridge 10 are provided separately from each other. However, the first and second ink cartridges 9, 10 may be formed integrally. In this case, it is desired that the configuration of the printer 1 be modified as needed.

In the illustrated embodiments, the first ink cartridge 9 and the second ink cartridge 10 are provided. However, independent ink cartridges may be provided for the ink packs B, C, M, Y, LC, and LM. In this case, the ink cartridges are controlled separately from one another and the reliability of the ink retained in the ink packs B, C, M, Y, LC, and LM is improved. Further, by using the multiple ink cartridges, the amount of the ink supplied to the recording head 8 is increased. If the ink cartridges are provided in this manner, it is desired that the configuration of the printer 1 be changed as necessary.

In the illustrated embodiments, the ink absorption body 17 is arranged in the first ink cartridge 9. However, an additional ink absorption body 17 may be provided in the second ink cartridge 10. In this case, even when the waste ink enters the second ink cartridge 10, the ink is quickly absorbed by the ink absorption body 17.

In the illustrated embodiments, the first ink cartridge 9 accommodates the ink pack B and the second ink cartridge 10 accommodates the ink packs C, M, Y, LC, and LM. However, the ink packs may be accommodated in any other suitable manner. That is, for example, the first ink cartridge 9 may accommodate the ink packs B and C and the second ink cartridge 10 may accommodate the ink packs M, Y, LC, and LM. Alternatively, the first or second ink cartridge 9, 10 may include an additional ink pack of a color that is the same as or different from that of any ink pack originally accommodated in the ink cartridge 9, 10. In this case, it is desired that the configuration of the printer 1 be modified as needed for supplying the ink of these colors to the recording head 8.

In the illustrated embodiments, the liquid ejection apparatus is embodied as the printer 1. However, the present invention may be embodied as any other suitable liquid ejection apparatus. For example, the present invention may be embodied as a liquid ejection apparatus ejecting liquid such as electrode material or color material used in fabrication of liquid crystal displays, EL displays, and surface emitting displays. Alternatively, present invention may be embodied as a liquid ejection apparatus ejecting liquid bioorganic matter used in fabrication of biochips or a sample ejection apparatus such as a precision pipette. In each of these cases, the configurations of the first and second ink cartridges 9, 10 may be changed as needed.

The invention claimed is:

1. A liquid ejection apparatus comprising:

a liquid ejection head for ejecting liquid;

a cap member for receiving waste liquid discharged from the liquid ejection head;

a waste liquid tank for retaining the waste liquid;

a gear pump for drawing the waste liquid from the cap member and introducing the waste liquid into the waste liquid tank, waste liquid backflow suppression means for suppressing backflow of the waste liquid to the cap member, and a liquid retainer that retains the liquid to be ejected and supplies the liquid to the liquid ejection head while being pressurized by pressurized air, wherein the waste liquid backflow suppression means is formed by a valve device, and wherein the gear pump generates the pressurized air for pressurizing the liquid retainer.

2. The apparatus according to claim 1, wherein the waste liquid backflow suppression means is arranged between the waste liquid tank and the gear pump or between the gear pump and the cap member.

3. The apparatus according to claim 1, wherein the valve device includes:

an inlet portion into which at least one of the waste liquid or the pressurized air is introduced;

an outlet portion through which the waste liquid or the pressurized air flows from the inlet portion to an exterior; and a valve body for connecting the inlet portion and the outlet portion to each other if the pressure of the pressurized air is not less than a predetermined reference level, and disconnecting the inlet portion from the outlet portion if the waste liquid and the pressurized air return from the outlet portion to the inlet portion.

4. A liquid ejection apparatus comprising:

a liquid ejection head for ejecting liquid;

a liquid retainer that retains the liquid to be ejected and supplies the liquid to the liquid ejection head while being pressurized by pressurized air;

a gear pump for generating the pressurized air for pressurizing the liquid retainer, and air backflow suppression means that permits supply of the pressurized air only to the liquid retainer.

5. The apparatus according to claim 4, wherein the air backflow suppression means is arranged between the liquid retainer and the gear pump or in a section upstream of the gear pump.

6. The apparatus according to claim 5, wherein the air backflow suppression means is formed by a valve device.

7. The apparatus according to claim 4, wherein the air backflow suppression means is formed by a valve device.

8. The apparatus according to claim 7, wherein the valve device includes: an inlet portion into which at least one of the waste liquid or the pressurized air is introduced;

an outlet portion through which the waste liquid or the pressurized air flows from the inlet portion to an exterior; and a valve body for connecting the inlet portion and the outlet portion to each other if the pressure of the pressurized air is not less than a predetermined reference level, and disconnecting the inlet portion from the outlet portion if the waste liquid and the pressurized air return from the outlet portion to the inlet portion.

9. A liquid ejection apparatus comprising:

a liquid ejection head for ejecting liquid;

a cap member for receiving the liquid ejected from the liquid ejection head as waste liquid;

a gear pump for drawing the waste liquid and air from the cap member;

a liquid retainer having a waste liquid retainer portion for retaining the waste liquid drawn by the gear pump and receiving the air as pressurized air, and a liquid retaining portion for retaining the liquid to be supplied to the liquid ejection head using the pressurized air; and fluid backflow suppression means for suppressing backflow of the waste liquid and the pressurized air to the cap member.

10. The apparatus according to claim 9, wherein the fluid backflow suppression means is arranged between the liquid retainer and the gear pump or between the gear pump and the cap member.

11. The apparatus according to claim 10, wherein the air backflow suppression means is formed by a valve device.

12. The apparatus according to claim 9, wherein the fluid backflow suppression means is formed by a valve device.

13. The apparatus according to claim 12, wherein the valve device includes:

an inlet portion into which at least one of the waste liquid or the pressurized air is introduced;

an outlet portion through which the waste liquid or the pressurized air flows from the inlet portion to an exterior; and a valve body for connecting the inlet portion and the outlet portion to each other if the pressure of the pressurized air is not less than a predetermined reference level, and disconnecting the inlet portion from the outlet portion if the waste liquid and the pressurized air return from the outlet portion to the inlet portion.

14. The apparatus according to claim 13, wherein the valve body of the valve device connects the inlet portion and the outlet portion to each other if the difference between the pressure in the inlet portion and the pressure in the outlet portion exceeds a predetermined reference value and disconnects the inlet portion from the outlet portion if the difference between the pressure in the inlet portion and the pressure in the outlet portion is equal to or smaller than the reference value.

15. A liquid ejection apparatus comprising:

a liquid ejection head for ejecting liquid;

a liquid retainer that retains the liquid to be ejected and supplies the liquid to the liquid ejection head while being pressurized by pressurized air;

a gear pump for generating the pressurized air for pressurizing the liquid retainer, and a valve device including an inlet portion which receives the pressurized air, an outlet portion through which the pressurized air exits the valve device for pressurizing the liquid retainer, and a valve body that places the inlet and outlet portions in fluid communication with each other if the pressure of the pressurized air is not less than a predetermined reference level, and disconnects the inlet portion from the outlet portion if pressurized air returns from the outlet portion to the inlet portion.

16. The apparatus according to claim 15, wherein the valve device is arranged between the liquid retainer and the gear pump.

17. The apparatus according to claim 15, wherein the valve device is arranged in a section upstream of the gear pump.

* * * * *